US007708592B2

(12) United States Patent
Schnare

(10) Patent No.: US 7,708,592 B2
(45) Date of Patent: May 4, 2010

(54) ADAPTER FOR A COAXIAL CABLE

(75) Inventor: Dirk Schnare, Düsseldorf (DE)

(73) Assignee: Vadafone Holding GmbH, Dusseldorft (DE)

( * ) Notice: Subject to any disclaimer, the term of this patent is extended or adjusted under 35 U.S.C. 154(b) by 0 days.

(21) Appl. No.: 12/391,420

(22) Filed: Feb. 24, 2009

(65) Prior Publication Data

US 2009/0215286 A1 Aug. 27, 2009

(30) Foreign Application Priority Data

Feb. 25, 2008 (DE) ..... 10 2008 010 930

(51) Int. Cl.
*H01R 9/05* (2006.01)

(52) U.S. Cl. ..... 439/581

(58) Field of Classification Search ..... 439/578, 439/581

See application file for complete search history.

(56) References Cited

U.S. PATENT DOCUMENTS

| | | | | | |
|---|---|---|---|---|---|
| 4,307,926 | A | * | 12/1981 | Smith | 439/607.52 |
| 4,397,516 | A | * | 8/1983 | Koren et al. | 439/607.45 |
| 4,431,254 | A | * | 2/1984 | Cartesse | 439/607.52 |
| 4,445,745 | A | * | 5/1984 | Cartesse | 439/585 |
| 4,869,690 | A | * | 9/1989 | Frear et al. | 439/675 |
| 5,376,022 | A | * | 12/1994 | Carr et al. | 439/668 |
| 6,309,250 | B1 | * | 10/2001 | Hyzin | 439/578 |
| 6,398,584 | B1 | * | 6/2002 | Hua et al. | 439/578 |
| 7,160,149 | B1 | * | 1/2007 | Chawgo | 439/578 |
| 2003/0121694 | A1 | | 7/2003 | Grogl | |

FOREIGN PATENT DOCUMENTS

| | | |
|---|---|---|
| DE | 9113236 | 1/1992 |
| DE | 20200701626 | 12/2007 |
| EP | 1890390 | 2/2008 |

OTHER PUBLICATIONS

English Language Abstract of DE202007010626 (Previously Filed on Mar. 5, 2009).
English Language Abstract of DE9113236 (Previously Filed on Mar. 5, 2009).
English Language Abstract of Non-Patent Literature Document: Bürklin Ohg (Previously Filed on Mar. 5, 2009).
Bürklin Ohg: Die ganze Elektronik '06/'07, München, 2005, S. 568, 596-597.—Firmenschrift.

* cited by examiner

*Primary Examiner*—Ross N Gushi
(74) *Attorney, Agent, or Firm*—International IP Law Group, P.C.

(57) ABSTRACT

An adapter for connecting a multi-core cable to a coaxial cable is provided. Adapters according to an exemplary embodiment of the present invention may be used in an arrangement comprising several adapters that are connected to each other using of a coaxial cable. Adapters and arrangements according to an exemplary embodiment of the present invention may allow a cost-effective conversion of existing mobile radio stations to modern RRH technology.

5 Claims, 4 Drawing Sheets

ADAPTER FOR A COAXIAL CABLE

CROSS REFERENCE TO RELATED APPLICATIONS

This application claims priority to German (DE) Patent Application No. 10 2008 010 930.4-34, filed on Feb. 25, 2008, the contents of which are incorporated by reference as if set forth in their entirety herein.

BACKGROUND

An exemplary embodiment of the present invention relates to an adapter for connecting a multi-core cable to a coaxial cable.

In contrast to mobile radio stations used up until now, so-called Remote Radio Head (RRH) stations have the advantage that a lower transmission capacity is needed since the high-frequency transmitter is situated much closer to the antenna and consequently only a shorter high-frequency line to the antenna is needed. This fact increases the efficiency of the mobile radio station substantially. Moreover, the transmitter mast of an RRH station can be installed up to several hundred meters away from the base station.

The term remote radio head is used in mobile radio technology to refer to the outdoor and weather-proof installation of the power supply, the transmitter and receiver module, the output amplifier and the filters on the antennas. The communication with the base station is usually effectuated via a fiberglass connection.

Up until now, the structure of RRH mobile radio stations with remote high-frequency transmitters has been expensive in comparison to conventionally constructed mobile radio systems since a power supply line and a data line had to be installed. So far, this is only cost-effective in the case of fairly long cables. However, an RRH mobile radio system entails considerable cost advantages in comparison to a conventionally constructed mobile radio system during ongoing operation.

In the state of the art, cables are known in which several types of conductors are combined in order to lower installation costs or in cases where exceptional difficulties have to be overcome.

German Utility Model DE 20 2007010626 U1 discloses a data-energy hybrid line. This hybrid line is intended for applications in high-frequency shielded areas and it combines electrically shielded direct voltage lines with potential-free optical fibers in one cable. U.S. Pat. Appln. 2003/0121694 A1 discloses a cable in which a power line, a data line and a control line are combined into a single cable having a shared sheathing.

The cables known from the state of the art, however, are not suitable for facilitating the conversion of existing mobile radio stations to modern RRH technology. Below, the terms mobile radio station and mobile radio system will be used synonymously.

SUMMARY OF THE INVENTION

Before this backdrop, an exemplary embodiment of the present invention may lower the point at which RRH mobile radio systems become cost-effective.

In order to achieve this objective, an exemplary embodiment of the present invention may relate to an adapter. In particular, an exemplary embodiment of the present invention may relate to an adapter for connecting a multi-core cable to a coaxial cable.

In an exemplary embodiment of the present invention, the adapter is configured as a plug. In such an exemplary embodiment, the plug has a contact pin in the center.

In another exemplary embodiment of the present invention, the adapter is configured as a socket. In such an exemplary embodiment, the socket has a contact socket in the center.

In an exemplary embodiment of the present invention, the multi-core cable is a two-core cable for supplying power. In another exemplary embodiment of the present invention, the multi-core cable is connected to the power supply of a mobile radio system. In another exemplary embodiment of the present invention, the multi-core cable is connected to a remote radio head.

The adapter according to an exemplary embodiment of the present invention may provide the advantage that it allows the cost-effective conversion of existing mobile radio systems to modern RRH technology.

Moreover, an exemplary embodiment of the present invention may relate to an arrangement having at least two adapters, whereby the adapters are connected to each other via a coaxial cable.

In a practical refinement of an arrangement according to an exemplary embodiment of the present invention, the coaxial cable is a feeder cable of a mobile radio system.

An arrangement according to an exemplary embodiment of the present invention may be characterized by the same advantages as the adapter.

Finally, an exemplary embodiment of the present invention may relate to a mobile radio station that is configured using RRH technology. The mobile radio station according to such an exemplary embodiment of the present invention may be equipped with an arrangement according to an exemplary embodiment of the present invention having several adapters.

A mobile radio station according to an exemplary embodiment of the present invention has the advantage that it can be built cost-effectively starting with an existing mobile radio station that uses conventional technology.

The above-mentioned and additional advantages, special aspects and practical refinements of the invention are also elucidated on the basis of the exemplary embodiments which will be described below with reference to the figures.

DETAILED DESCRIPTION OF SPECIFIC EMBODIMENTS

An exemplary embodiment of the present invention relates to an arrangement comprising several adapters that are connected to each other using a coaxial cable. Moreover, an exemplary embodiment of the present invention relates to a mobile radio station that is equipped with an arrangement according to an exemplary embodiment of the present invention.

Figure 1:
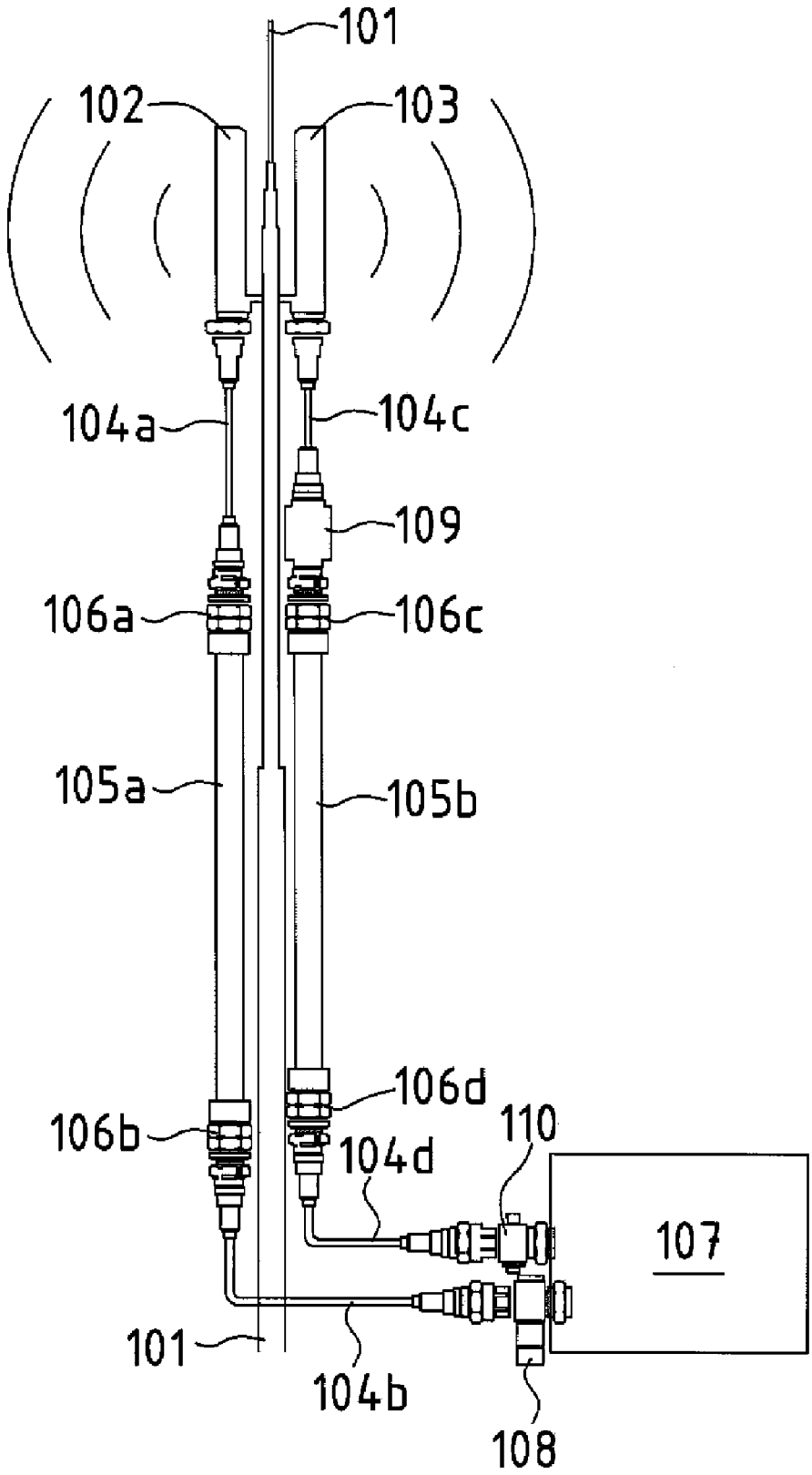
FIG. 1*a* is a perspective view of a conventional mobile radio antenna system.

FIG. 1 schematically shows a conventionally structured mobile radio antenna system. Here, not all of the drawn components necessarily have to be used. Several transmitting and receiving antennas are mounted on a mast 101. FIG. 1—by way of example and representative of all of the mounted antennas—shows a transmitting antenna 102 and a receiving antenna 103. The transmitting antenna 102 is connected via a so-called jumper cable 104*a* to a feeder cable 105*a* for the high-frequency signal that is to be emitted. The feeder cable 105*a* is typically a coaxial cable with a diameter of ⅞" (2.2 cm), 1¼" (3.18 cm), 1⅝" (4.13 cm) or 2¼" (5.72 cm), and having a hollow inner conductor made of copper. The connection between the feeder cable 105*a* and the jumper cable 104*a* is established with a 7/16" or N-plug connection 106*a*. Another jumper cable 104*b* is connected at the lower end of the feeder cable 105*a*, said jumper cable 104*a* establishing a connection to a base station 107. A 7/16" connection 106*b* is arranged between the jumper cable 104*b* and the feeder cable 105*a*. An overvoltage protection 108 with a λ/4 short-circuit is arranged between the base station 107 and the jumper cable 104*b*, and it serves to protect the antenna system against overvoltage.

As far as the signals are concerned, the connection between the base station 107 and the receiving antenna 103 is set up completely analogously to the case between the transmitting antenna 102 and the base station 107. A jumper cable 104*c* leads from the receiving antenna 103 to an antenna preamplifier 109. The antenna preamplifier 109 is connected via a plug connection 106*c* to a feeder cable 105*b*. The lower end of the feeder cable 105*b* is connected via a jumper cable 104*d* to the base station 107. An overvoltage arrester 110 with an expulsion-type arrester is installed between the base station 107 and the jumper cable 104*d*. A 7/16" or N-plug connection is arranged between the jumper cable 104*d* and the feeder cable 105*b*.

In conventional mobile radio systems, the high-frequency transmitter in the base station 107 is thus connected to an associated antenna via only one coaxial cable 105*a* or 105*b*. In mobile radio systems that use modern RRH technology, a larger number of connections is needed between the base station and the antenna, as will be elaborated upon below.

Figure 2:
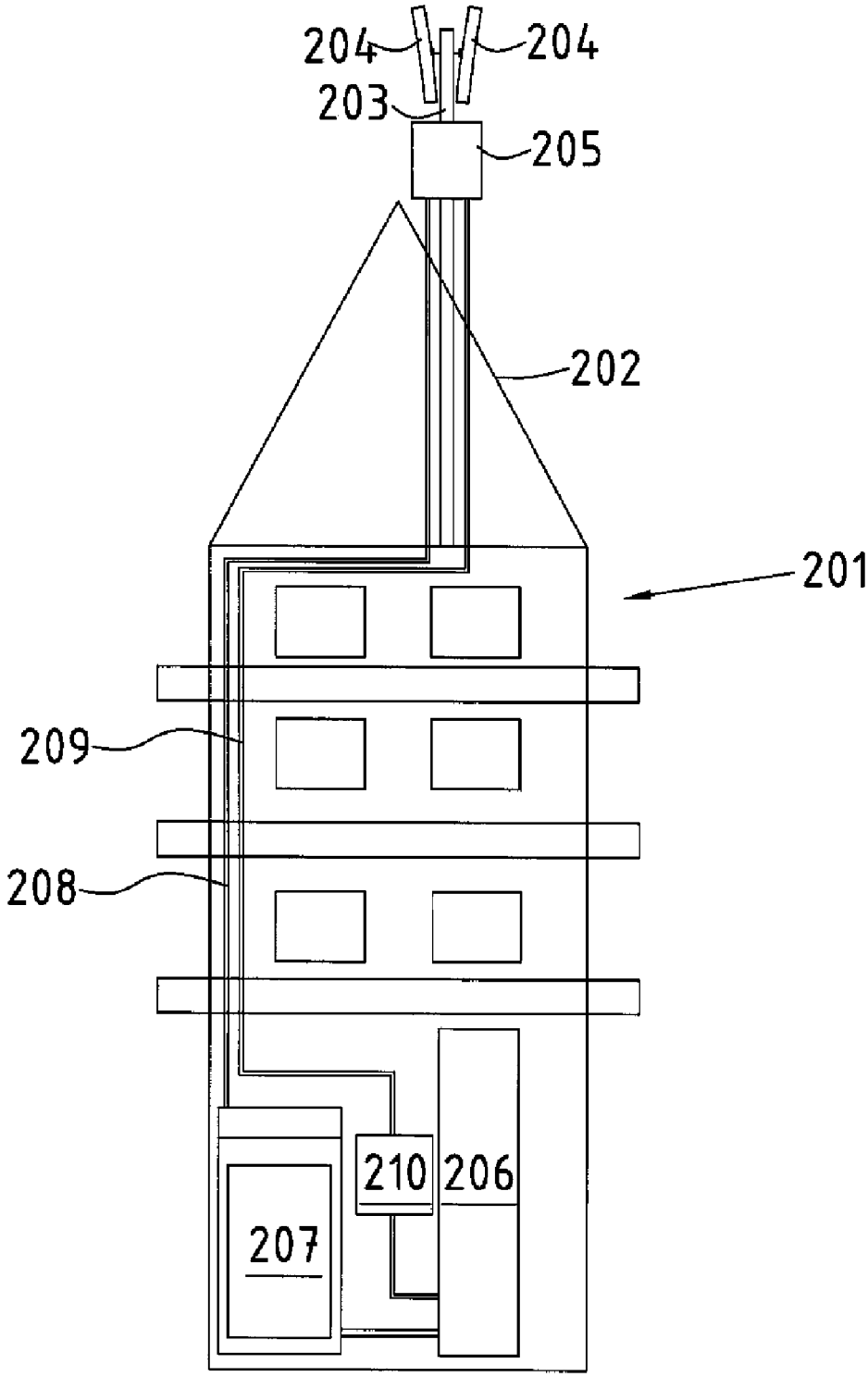
FIG. 2 is a perspective view of an RRH mobile radio system.

FIG. 2 schematically shows a mobile radio system that uses modern RRH technology and that is installed in a tall building 201. On the roof 202 of the building 201, there is a mast 203 on which several antennas 204 are installed. A high-frequency transmitter 205 is installed on the mast 203 in the immediate vicinity of the antennas 204. The high-frequency transmitter 205 is also referred to as a remote radio head (RRH) 205. A power supply 206 for the system is installed in the lower section of the building 201, for example, in the basement or on the ground floor. A so-called base station 207 with a radio server is accommodated along with the power supply 206. As far as the signals are concerned, the base station 207 is connected to the RRH 205 via a data line 208 for purposes of data exchange. Typically, the data line 208 is an optical data cable for transmitting optical data. Moreover, a power line 209 leads from the power supply 206 to the RRH 205. The power line 209 is typically a 48-volt current connection. In the conventional manner, a fuse box 210 is installed between the power supply 206 and the RRH 205.

As an alternative to the exemplary embodiment of the mobile radio system shown in FIG. 2, the mobile radio system can also be installed in a tower or on a tall mast.

Consequently, when it comes to RRH mobile radio systems, in addition to the coaxial cables that have been installed until now in mobile radio sites that use conventional technology, additional optical cables have to be installed for the construction of mobile radio systems of the new generation. Moreover, a 48-volt power connection has to be installed in order to supply the remote radio heads that are near the antennas.

Up until now, when a new mobile radio system was built or when an existing one was modernized, there was a need to install a separate data line as well as a cable for supplying power to the RRH. As a result, costly work has to be carried out on the cable routes, especially in terms of fire protection, the wall openings have to be enlarged, etc., so that today, RRH systems are only cost-effective in the case of fairly long cables.

Therefore, in a parallel, likewise pending, patent application filed by the same patent applicant, it is being proposed that the hollow inner conductor of the existing coaxial cable be used, in a manner of speaking, as an empty conduit for an optical data cable for the RRH 205. At the same time, it is being proposed that the inner conductor or the outer conductor of the coaxial cable be used for the power supply of the RRH 205. This fundamental idea is not the subject matter of the present invention. On the contrary, an exemplary embodiment of the present invention relates to an adapter that is needed for the new utilization of the feeder cable that is present in conventional mobile radio systems.

Figure 3A:
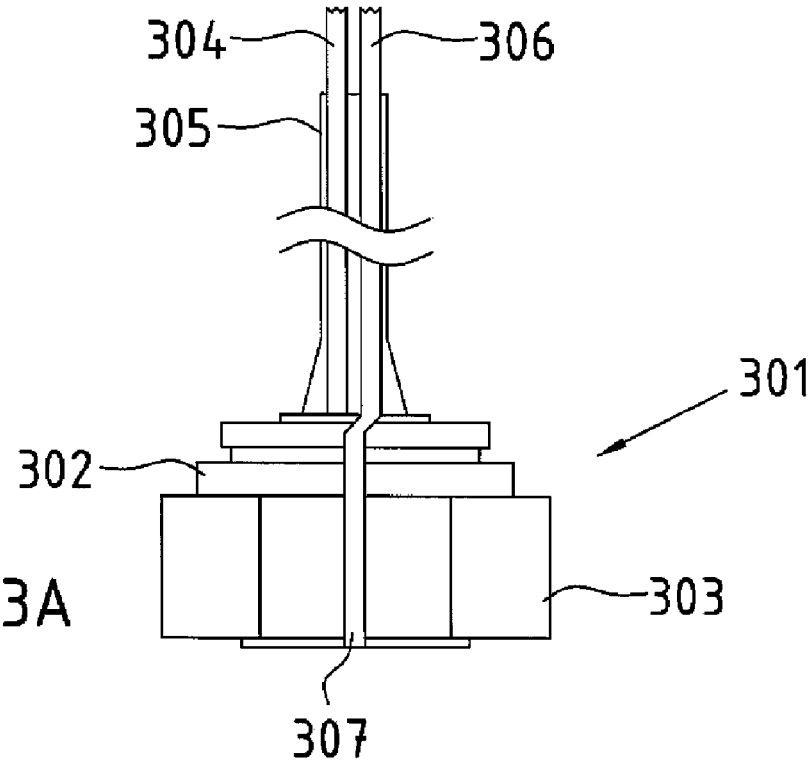
FIGS. 3A and 3B are perspective views of an adapter according to an exemplary embodiment of the present invention, partially in a cross sectional view.

FIG. 3A schematically shows an adapter 301 according to an exemplary embodiment of the present invention, which is configured as a plug. The adapter 301 has a plug housing 302 made of metal fitted with a cap nut 303. A first core 304 of a two-core line 305 is connected to the plug housing 302. A second core 306 is connected to a central contact pin 307. The contact pin 307 and the second core 306 are arranged in the housing 302 so as to be electrically insulated.

The dimensions of the adapter 301 correspond to a 7/16" or N-plug connection, and it allows the connection to a 7/16" coaxial connection socket. In this manner, the adapter 301 makes it possible to connect the two-core line 305 to a coaxial cable. The dimension 7/16", rather than other dimensions, was selected in conjunction with the present invention only by way of an example, since coaxial sockets or plugs in mobile radio systems normally have this diameter. Exemplary embodiments of the present invention, however, are, of course, not limited to this diameter.

There are also mobile radio systems in which the ends of the feeder cable are provided with coaxial plugs instead of sockets. In such cases, a different type of adapter is needed, which is described in conjunction with FIG. 3B.

Figure 3B:
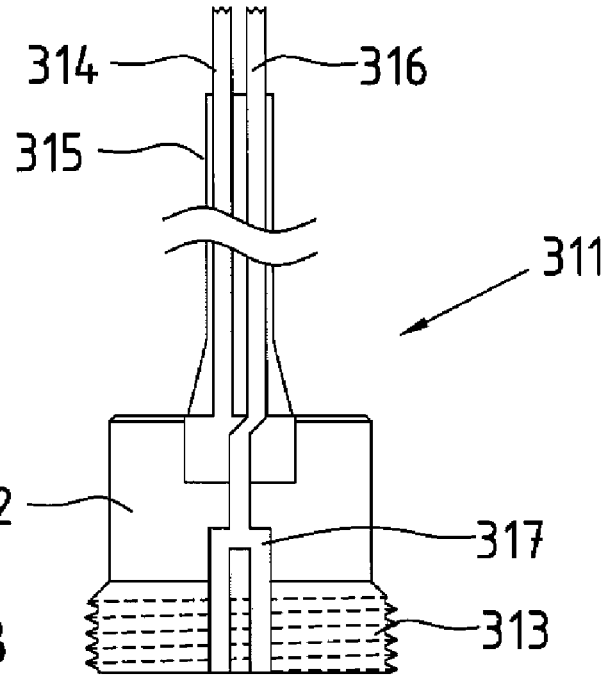

FIG. 3B schematically shows an adapter 311 according to an exemplary embodiment of the present invention that is configured as a socket. The adapter 311 has a housing 312 made of metal, which is provided with an external thread 313. A first core 314 of a two-core line 315 is connected to the housing 312. A second core 316 is connected to a centrally arranged contact socket 317. The contact socket 317 and the second core 306 are arranged in the housing 312 so as to be electrically insulated.

Figure 4:
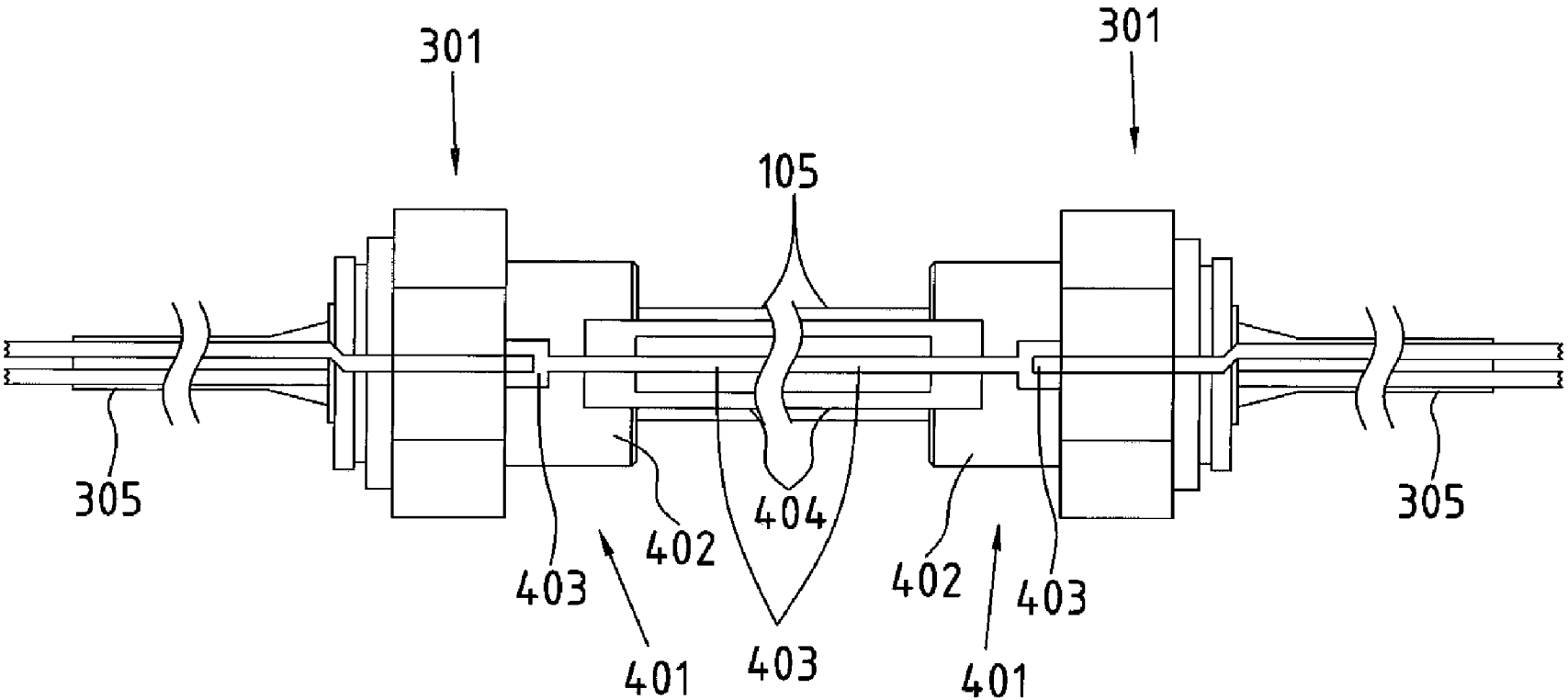
FIG. 4 is a perspective view of an exemplary embodiment of the present invention being used in a mobile radio system.

FIG. 4 shows an arrangement with two adapters 301 that are mounted on an already existing feeder cable 105 in a mobile radio system. Each of the ends of the feeder cable 105 is provided with a connection socket 401. The connection area of the connection socket 401 is structured with a housing 402 and a contact socket 403 in the center, completely analogously to the connection area of the socket 311. An adapter 301 configured as a plug is inserted into each connection socket 401 and is affixed by tightening the cap nut 303 on an external thread of the connection socket 401.

The two-core cables 305 are connected to the power supply 206 on one side and to the RRH 205 on the other side. The feeder cable 105 extends between both of the two-core cables

305. This means that the 48-V power supply inside the mobile radio system runs via the feeder cable 105 that is no longer used as a high-frequency cable, whereby the two cores of the two-core cable are connected to the inner conductor 403 or to an outer conductor 404 of the feeder cable 105.

In order to ensure shock-hazard protection, the metal surfaces that are exposed on the adapters 301 can be insulated with shrinkdown plastic tubing or with self-bonding bitumen tape.

If the ends of the feeder cable 105 in a mobile radio system are not provided with sockets but rather with plugs, then the adapter 311 is used. The fundamental mode of operation is the same with both versions.

This approach for converting already existing mobile radio stations to the new RRH technology has a number of advantages. These include especially a simplified installation and thus the possibility to cut costs, since no new cable routes have to be built. For example, it is avoided that new wall openings have to be created. Moreover, the additional data line 108 does not have to be tied in place.

Thanks to the proposed utilization of the already installed feeder cable for the power supply, existing mobile radio stations can be converted to the new RRH technology much less expensively.

LIST OF REFERENCE NUMERALS

101 mast
102 transmitting antenna
103 receiving antenna
104*a-d* jumper cable
105*a-b* feeder cable
106*a-d* plug connection
107 base station
108 overvoltage protection
109 antenna preamplifier
110 overvoltage arrester
201 building
202 roof
203 mast
204 antennas
205 remote radio head (RRH), high-frequency transmitter
206 power supply
207 base station
208 data line
209 power line
210 fuse box
301 adapter
302 housing
303 cap nut
304 first core
305 two-core cable
306 second core
307 contact pin
311 adapter
312 housing
313 external thread
314 first core
315 two-core cable
316 second core
317 contact socket
401 connection socket
402 housing
403 inner conductor
404 outer conductor

The invention claimed is:

1. A connector system connecting a power supply with a high frequency emitter in a mobile radio station, the connector system comprising:

a first and a second multi-core cable, each having a conducting element;

a co-axial cable having a conducting element;

an adapter that receives one multi-core cable and the co-axial cable and connects the conducting element of the multi-core cable to the conducting element of the co-axial cable;

wherein the connector system is arranged such that the first multi core cable connects the power supply with a first adapter;

wherein the second multi-core cable connects a second adapter with the high-frequency emitter; and wherein the first and the second adapters are connected to a first and a second end of the co-axial cable.

2. The connector system recited in claim 1, wherein the adapter is configured as a plug.

3. The connector system recited in claim 2, wherein the plug comprises a contact pin in the center.

4. The connector system recited in claim 1, wherein the adapter is configured as a socket.

5. The connector system recited in claim 4, wherein the socket comprises a contact socket in the center.

* * * * *

UNITED STATES PATENT AND TRADEMARK OFFICE

CERTIFICATE OF CORRECTION

PATENT NO. : 7,708,592 B2
APPLICATION NO. : 12/391420
DATED : May 4, 2010
INVENTOR(S) : Dirk Schnare It is certified that error appears in the above-identified patent and that said Letters Patent is hereby corrected as shown below:

On title page, Assignee should read:
Assignee: Vodafone Holding GmbH, Düsseldorf, Germany Signed and Sealed this Tenth Day of August, 2010

David J. Kappos

David J. Kappos
*Director of the United States Patent and Trademark Office*